US009902466B2

(12) United States Patent
Vlasblom et al.

(10) Patent No.: US 9,902,466 B2
(45) Date of Patent: Feb. 27, 2018

(54) OFFSHORE DRILLING OR PRODUCTION VESSEL WITH SINGLE LENGTH MOORING LINE OF HIGH STRENGTH POLYOLEFIN FIBERS

(71) Applicant: DSM IP ASSETS B.V., Heerlen (NL)

(72) Inventors: Martin Pieter Vlasblom, Echt (NL); Jorn Boesten, Echt (NL); Rigobert Bosman, Echt (NL)

(73) Assignee: DSM IP ASSETS B.V., Heerlen (NL)

( * ) Notice: Subject to any disclaimer, the term of this patent is extended or adjusted under 35 U.S.C. 154(b) by 133 days.

(21) Appl. No.: 14/433,445

(22) PCT Filed: Oct. 9, 2013

(86) PCT No.: PCT/EP2013/071052
§ 371 (c)(1),
(2) Date: Apr. 3, 2015

(87) PCT Pub. No.: WO2014/056982
PCT Pub. Date: Apr. 17, 2014

(65) Prior Publication Data

US 2015/0259042 A1 Sep. 17, 2015

(30) Foreign Application Priority Data

Oct. 11, 2012 (EP) ..... 12188166

(51) Int. Cl.
*B63B 21/20* (2006.01)
*B63B 21/50* (2006.01)
(Continued)

(52) U.S. Cl.
CPC ..... *B63B 21/50* (2013.01); *B63B 9/065* (2013.01); *B63B 21/20* (2013.01); *B63B 35/44* (2013.01);
(Continued)

(58) Field of Classification Search
CPC ..... D07B 2501/2061; D07B 1/02; B63B 2021/203; B63B 21/50; B63B 9/065;
(Continued)

(56) References Cited

U.S. PATENT DOCUMENTS 2,407,634 A * 9/1946 Du Pont ..... B64D 3/00 182/190
4,413,110 A 11/1983 Kavesh et al.
(Continued)

FOREIGN PATENT DOCUMENTS

DE 26 26 659 12/1977
DE 295 00 885 12/1995
(Continued)

OTHER PUBLICATIONS

International Search Report for PCT/EP2013/071052 dated Nov. 7, 2013, three pages.
T. Nakajima, "Advanced fiber spinning technology", *Society of Fiber Science & Technology*, 1994, 21 pages.

*Primary Examiner* — Ajay Vasudeva
(74) *Attorney, Agent, or Firm* — Nixon Vanderhye P.C.

(57) ABSTRACT

The invention relates to an offshore drilling or production vessel comprising a platform and a mooring system attached thereto, said mooring system comprising: i.) a support frame with a winch-drum mounted thereon; ii.) a mooring line for mooring said platform to the ocean floor, said mooring line comprising a first portion and a second portion; wherein said first portion is hauled on and paid off by said winch-drum; wherein said second portion is anchored to the ocean floor; characterized in that the mooring line is a single length mooring line comprising high strength polyolefin fibers; wherein the first portion of the mooring line has a first mass (M1) of polyolefin fibers per unit length and the second portion of the mooring line has a second mass (M2) of polyolefin fibers per unit length; wherein the ratio M1/M2 is
(Continued)

greater than 1 and wherein said first portion extends continuously into said second portion through a tapered portion of the mooring line.

13 Claims, 2 Drawing Sheets

(51) Int. Cl.

| | |
|---|---|
| ***B63B 35/44*** | (2006.01) |
| ***D07B 1/02*** | (2006.01) |
| ***B63B 9/06*** | (2006.01) |
| ***E02D 27/10*** | (2006.01) |
| ***E02D 27/52*** | (2006.01) |

(52) U.S. Cl.
CPC ..... *B63B 35/4413* (2013.01); *D07B 1/02* (2013.01); *E02D 27/10* (2013.01); *E02D 27/52* (2013.01); *B63B 2021/203* (2013.01); *D07B 2501/2061* (2013.01)

(58) Field of Classification Search
CPC ..... B63B 35/44; B63B 35/4413; B63B 21/20; E02D 27/52; E02D 27/10
See application file for complete search history.

(56) References Cited

U.S. PATENT DOCUMENTS

| | | | | |
|---|---|---|---|---|
| 6,009,825 | A | 1/2000 | Fulton et al. | |
| 2009/0235629 | A1* | 9/2009 | Bosman | B63B 21/20 57/255 |
| 2010/0286728 | A1* | 11/2010 | Simmelink | D01D 5/04 606/228 |
| 2014/0033906 | A1* | 2/2014 | Erlendsson | D04C 1/12 87/8 |

FOREIGN PATENT DOCUMENTS

| | | |
|---|---|---|
| EP | 0 205 960 | 12/1986 |
| EP | 0 213 208 | 3/1987 |
| EP | 0 200 547 | 7/1991 |
| EP | 0 472 114 | 2/1992 |
| EP | 1 699 954 | 11/2011 |
| GB | 2 042 414 | 9/1980 |
| GB | 2 051 667 | 1/1981 |
| WO | WO 01/73173 | 10/2001 |
| WO | WO 2005/066401 | 7/2005 |
| WO | WO 2007/096121 | 8/2007 |
| WO | WO 2011/104310 | 9/2011 |

* cited by examiner

OFFSHORE DRILLING OR PRODUCTION VESSEL WITH SINGLE LENGTH MOORING LINE OF HIGH STRENGTH POLYOLEFIN FIBERS

This application is the U.S. national phase of International Application No. PCT/EP2013/071052 filed 9 Oct. 2013 which designated the U.S. and claims priority to EP Patent Application No. 12188166.8 filed 11 Oct. 2012, the entire contents of each of which are hereby incorporated by reference.

FIELD

The invention relates to offshore drilling or production vessel, also known as a production platform, comprising a platform and a mooring system attached thereto, said mooring system comprising:

i. a support frame with a winch-drum mounted thereon;

ii. a mooring line for mooring said platform to the ocean floor, said mooring line comprising a first portion and a second portion; wherein said first portion is hauled on and paid off by said winch-drum; wherein said second portion is anchored to the ocean floor;

The invention further relates to a mooring system such as the one described above and a mooring line.

SUMMARY

An offshore drilling or production vessel is essentially a massive floating vessel used in the offshore exploration, drilling and production of oil and gas. In broad terms, the typical offshore drilling or production vessel generally includes at least two large pontoon hulls which float in water and support a platform having a deck which contain various drilling; exploration or production equipment. The vessel must be moored or anchored to the ocean floor and typically each of its corners contains at least one mooring system for anchorage, said system being often placed on or near the deck of said platform, usually above the waterline. In this position, mooring lines contained by said mooring system extend from the deck to the seabed.

Usual mooring systems for anchoring large vessels such as an offshore drilling or production vessel are basically of three types (1) a mooring winch using large diameter wire ropes to raise and lower an anchor; (2) a mooring windlass which uses large chains to raise and lower the anchor; and (3) a combination mooring system which contains both a winch and a windlass and uses a combination wire rope and chain to raise and lower the anchor.

It is further well known to use synthetic ropes such as ropes manufactured from high performance polyethylene fibers (e.g. as sold by DSM Dyneema, NL) as mooring lines instead of the heavy and large diameter wire ropes or chains. A synthetic mooring line is for example known from WO2007/096121 and it comprises a plurality of various segments or modules of rope, the various segments having different compositions of synthetic fibers. Such mooring line successfully mitigates the various stresses induced by the up and down movement of the offshore vessel generated by the water currents, winds or waves.

The mooring lines need to fulfill a series of strict requirements in order to be suitable for use, the requirements being dependent on the environment the lines operate. For example their estimated operational timelife is usually at least 5 years for offshore vessels that are temporarily stationed at a certain location, e.g. exploration or drilling offshore vessels; and more than 25 years for vessels that are used in production. Other requirements specify that the mooring line has to operate at loads of around 20% of their breaking strength and that its safety factor over the design service life against break should be anywhere between 3× to 10×. Such large safety factors which are usually 3 for mooring mobile platforms and between 5 and 8 for long-term mooring, typically mean that the mooring lines need to be over designed.

An inconvenience of using synthetic ropes as mooring lines for offshore vessels is their moderate response to factors acting thereupon in rather harsh environments, such as high temperatures especially above the waterline, abrasion and other types of damages. Especially a mooring line which extends from the deck of a platform to the seabed it is exposed at the same time to different environments having different characteristics; e.g. high temperatures and increased damage probability above the waterline and lower temperatures and saline or corrosive environment below the waterline to name just a few. To mitigate these differences, WO2007/096121 proposes to use a modular mooring line with modules tuned for specific environments, i.e. a line comprising a chain part for use above waterline, a module made from first low elongation synthetic fibers for the environment just below the waterline; and a module utilizing high strength polyethylene fibers for large depths.

Although successfully mitigating most of the strict requirements, the mooring line of WO2007/096121 can be further improved. In particular for some offshore vessels, having a mooring system containing a modular mooring line may be undesirable. It may thus be an aim of the present invention to provide an offshore vessel which has a mooring system including a mooring line that is able to mitigate the requirements imposed by the different environments that the line operates without the need of modules.

The invention provides an offshore drilling or production vessel comprising a platform and a mooring system attached thereto, said mooring system comprising:

i. a support frame with a winch-drum mounted thereon;

ii. a mooring line for mooring said platform to the ocean floor, said mooring line comprising a first portion and a second portion; wherein said first portion is hauled on and paid off by said winch-drum; wherein said second portion is anchored to the ocean floor;

wherein the mooring line is a single length mooring line comprising high strength polyolefin fibers; wherein the first portion of the mooring line has a first mass (M1) of polyolefin fibers per unit length and the second portion of the mooring line has a second mass (M2) of polyolefin fibers per unit length; wherein the ratio M1/M2 is greater than 1 and wherein said first portion extends continuously into said second portion through a tapered portion of the mooring line.

It was observed that the offshore vessel of the invention has a good dynamic response to normal wind, waves and water currents influences. Also due to the presence of the mooring system and in particular of the single length textile mooring line used in accordance with the invention, easier inspection and maintenance may be available. By single length mooring line is herein understood a non-interrupted mooring line having a continual length at least equal with the length between the winch and the seabed, including also the portion of the mooring line which is hauled on and paid off by said winch-drum. In accordance with the invention a non-interrupted mooring line is a continual line; e.g. free of any intermissions or any interruptions in its construction along its length such as those introduced for example by connection means, e.g. rings, hooks, shackles, knots, and the like.

DETAILED DESCRIPTION

Figure 1:
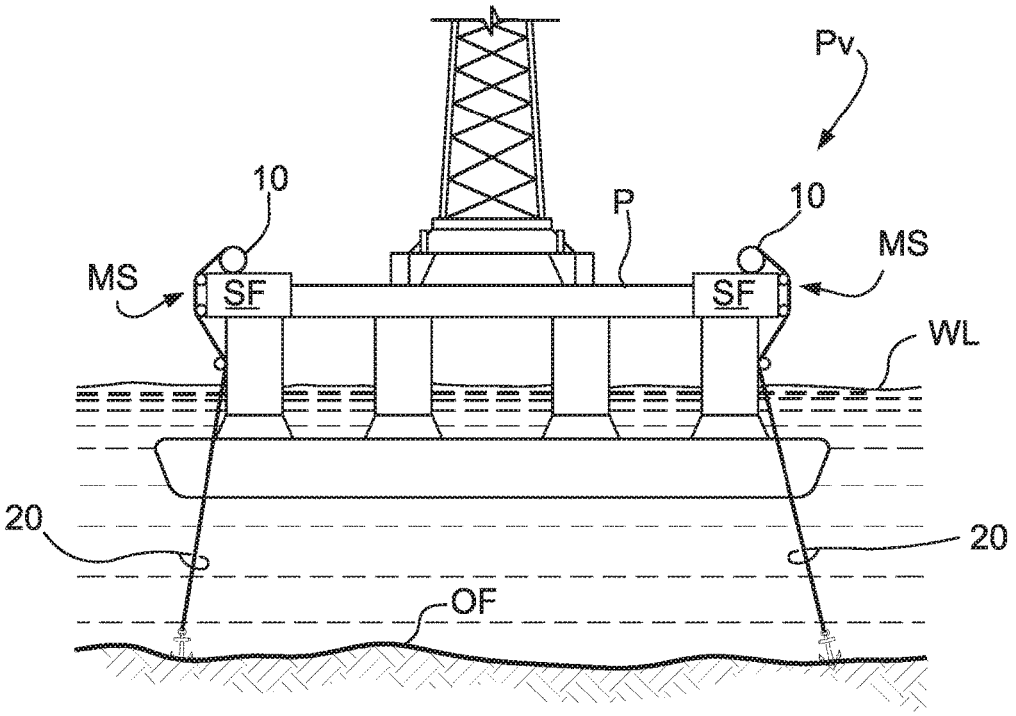
FIG. 1 is a schematic view of an offshore drilling or production vessel having a platform and a mooring system attached to the platform, the mooring system comprising a support frame with winch-drum mounted thereon and a single length mooring line having first and second portions such that the first portion extends continuously into the second portion through a tapered portion of the mooring line.

FIG. 1 schematically depicts an offshore drilling or production vessel PV having a platform P and mooring systems MS attached to the platform P, the mooring systems MS each comprising a support frame SF with a winch-drum 10 mounted thereon. Each winch drum 10 includes a single length mooring line 20 having first and second portions 20*a*, 20*b* such that the first portion 20*a* extends continuously into the second portion 20*b* through a tapered portion 20*c* (see FIG. 2).

As noted above, the mooring line 20 used in accordance with the invention has a first portion 20*a* and a second portion 20*b*, wherein the first portion 20*a* is hauled on and paid off by the winch-drum 10, wherein the second portion 20*b* is anchored to the ocean floor OF (see FIG. 1). The first portion 20*a* has a first mass (M1) of high tenacity polyolefin fibers per unit length and said second portion 20*b* has a second mass (M2) of high tenacity polyolefin fibers per unit length. Preferably, the first portion 10*a* substantially extends until at most 10 meters below the waterline WL (see FIG. 1), more preferably until at most 5 meters below the waterline WL, even more preferably at least 5 meters above the waterline WL, most preferably at most 1 meter from the winch-drum 10. Preferably, the second portion 20*b* substantially extends from at least 10 meters below the waterline WL, more preferably at least 50 meters below the waterline WL, most preferably at least 100 below the waterline WL. The waterline WL is herein considered an imaginary line indicating the level reached by the sea water under normal conditions; and in locations affected by tides, the waterline WL is understood the highest level reached by water.

The ratio M1/M2 is greater than 1.0; preferably the ratio is at least 1.1, more preferably at least 1.2, most preferably at least 1.3. It was observed that the advantages of the invention are more prominent when such preferred ratios are used. For practical reasons, said ratio is at most 5.0, most preferably at most 4.0, most preferably at most 3.0.

The first and second mass of high tenacity polyolefin fibers (M1 and M2, respectively) are preferably chosen with due regard to the location where the offshore vessel of the invention operates.

In a preferred embodiment, said platform P operates in an environment wherein there is a temperature of at least 15° C., more preferably at least 20° C., most preferably at least 25° C., of the environment above the waterline WL, the temperature being measured under normal weather conditions, e.g. as reported by the weather stations delivering weather reports at that specific location. Preferably, the first portion 20*a* of the mooring line 20 has a specific strength of at least 0.80, more preferably at least 1.00, even more preferably at least 1.15, more preferably at least 1.30, most preferably at least 1.50; preferably, the specific strength of the first portion 20*a* of the mooring line 20 is at most 3.00, more preferably at most 2.00, most preferably at most 1.60. The specific strength of a mooring line may be expressed in kN/(g/m) and is the ratio between its breaking strength (in kN) and its linear mass (in g/m). The breaking strength of the mooring line is the load at which said line breaks and can be measured with a Zwick 1474 Winding grip/800 kN horizontal tensile tester (from Mennens b.v., NL).

In a further preferred embodiment, the platform P operates in an environment wherein there is a temperature of at most 25° C., more preferably at most 20° C., most preferably at most 16° C., of the water at 1 meter depth below the waterline WL. Preferably, the second portion 20*b* of the mooring line has a specific strength of at least 1.2, more preferably at least 1.4, most preferably at least 1.6; preferably, said specific strength of said first portion is at most 3.0, more preferably at most 2.0.

Preferably, the ratio of the specific strength of the first portion 20*a* to the specific strength of the second portion 20*b* of the mooring line 20 is between 0.50 and 0.98; more preferably between 0.65 and 0.94; most preferably between 0.75 and 0.88.

Figure 2:
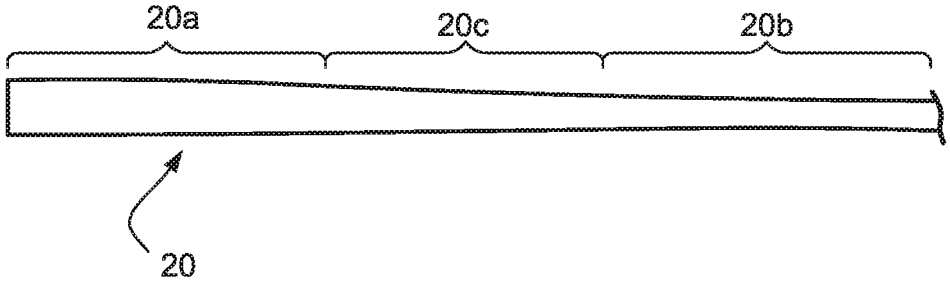
FIG. 2 is an enlarged view of the tapered juncture between the first and second portions of the mooring line employed in the mooring system of the vessel depicted in FIG. 1.

In accordance with the invention, the first portion 20*a* extends continuously into the second portion 20*b* through a tapered portion 20*c* as is schematically depicted by FIG. 2. By tapered portion 20*c* is herein understood a portion of the mooring line wherein a gradual decrease in the mass of polyolefin fibers per unit length takes place, between M1 and M2. Preferably, the tapered portion 20*c* has a length L (in meters) which is computed with formula 1

$$L=L_1+L_2 \qquad \text{formula 1}$$

wherein $L_1$ is a first length of the first portion 20*a* of the mooring line 20, the first length being equal with the length of the mooring line 20 which operates between the waterline WL and the height where the temperature of the environment is at its maximum; and $L_2$ is a second length of the second portion 20*b* of the mooring line 20, the second length being equal with the length of the mooring line 20 which operates between the waterline WL and the water depth where the temperature of the water is about 16° C. The tapered portion 20*c* can be achieved for example by progressively removing polyolefin fibers from the mooring line along a chosen portion thereof to create a gradient in the mass of polyolefin fibers per unit length along that chosen portion from M1 to M2.

Preferred polyolefin fibers are fibers manufactured from homopolymers or copolymers of polypropylene or polyethylene. More preferably, the polyolefin is a polyethylene, most preferably an ultrahigh molecular weight polyethylene (UHMWPE). By UHMWPE is herein understood a polyethylene having an intrinsic viscosity (IV) of at least 3 dl/g, more preferably at least 4 dl/g, most preferably at least 5 dl/g. Preferably said IV is at most 40 dl/g, more preferably at most 25 dl/g, more preferably at most 15 dl/g. The IV may be determined according to ASTM D1601(2004) at 135° C. in decalin, the dissolution time being 16 hours, with BHT (Butylated Hydroxy Toluene) as anti-oxidant in an amount of 2 g/l solution, by extrapolating the viscosity as measured at different concentrations to zero concentration. Preferably, the UHMWPE fibers are gel-spun fibers, i.e. fibers manufactured with a gel-spinning process. Examples of gel spinning processes for the manufacturing of UHMWPE fibers are described in numerous publications, including EP 0205960 A, EP 0213208 A1, U.S. Pat. No. 4,413,110, GB 2042414 A, GB-A-2051667, EP 0200547 B1, EP 0472114 B1, WO 01/73173 A1, EP 1,699,954 and in "Advanced Fibre Spinning Technology", Ed. T. Nakajima, Woodhead Publ. Ltd (1994), ISBN 185573 182 7.

By fiber is herein understood an elongated body having a length dimension and transverse dimensions, e.g. a width and a thickness or a diameter, wherein the length dimension is much greater that the transverse dimensions. The term fiber also includes various embodiments e.g. a filament, a ribbon, a strip, a band, a tape and the like having regular or irregular cross-sections. The fiber may have a continuous length, also referred to as a filament, or a discontinuous length in which case is referred to in the art as staple fibers. A preferred fiber for use in accordance with the invention is a filament having preferably an essentially rounded cross-section. A yarn for the purpose of the invention is an elongated body containing a plurality of fibers.

The high strength polyolefin fibers used in accordance with the present invention are preferably fibers having a tensile strength of at least 0.5 GPa, more preferably of at least 1.2 GPa, even more preferably of at least 2.5 GPa, most preferably of at least 3.1 GPa. When the polyolefin fibers are UHMWPE fibers, said UHMWPE fiber preferably have a tensile strength of at least 1.2 GPa, more preferably of at least 2.5 GPa, most preferably at least 3.5 GPa. Preferably the polyolefin fibers have a tensile modulus of at least 30 GPa, more preferably of at least 50 GPa, most preferably of at least 60 GPa. Preferably the polyolefin fibers are UHMWPE fibers having a tensile modulus of at least 50 GPa, more preferably of at least 60 GPa, most preferably of at least 80 GPa.

Preferably, the polyolefin fibers and in particular the UHMWPE fibers employed by the invention have deniers in the range of from 0.5 to 20, more preferably from 0.7 to 10, most preferably from 1 to 5 dpf. If yarns containing said fibers are used to manufacture the fibrous sheath, preferably said yarns have deniers in the range of from 100 den to 3000 den, more preferably from 200 den to 2500 den, most preferably from 400 den to 1000 den.

In a special embodiment, the polyolefin fibers used in accordance to the invention have a tape-like shape or, in other words, said polyolefin fibers are polyolefin tapes. Preferably said polyolefin tapes are UHMWPE tapes. A tape (or a flat tape) for the purposes of the present invention is a fiber with a cross sectional aspect ratio, i.e. ratio of width to thickness, of preferably at least 5:1, more preferably at least 20:1, even more preferably at least 100:1 and yet even more preferably at least 1000:1. The tape preferably has a width of between 1 mm and 600 mm, more preferable between 1.5 mm and 400 mm, even more preferably between 2 mm and 300 mm, yet even more preferably between 5 mm and 200 mm and most preferably between 10 mm and 180 mm. The tape preferably has a thickness of between 10 μm and 200 μm and more preferably between 15 μm and 100 μm. By cross sectional aspect ratio is herein understood the ratio of width to thickness.

In a preferred embodiment, the polyolefin fibers are creep-optimized UHMWPE fibers obtained by spinning an UHMWPE comprising olefinic branches (OB) and having an elongational stress (ES), and a ratio $$\left(\frac{OB/1000\ C}{ES}\right)$$

between the number of olefinic branches per thousand carbon atoms (OB/1000C) and the elongational stress (ES) of at least 0.2, wherein said UHMWPE fibers when subjected to a load of 600 MPa at a temperature of 70° C., have a creep lifetime of at least 90 hours, preferably of at least 100 hours, more preferably of at least 110 hours, even more preferably of at least 120 hours, most preferably of at least 125 hours. Preferably the UHMWPE has an intrinsic viscosity (IV) of at least 5 dl/g. Preferably, the olefinic branches have a number of carbon atoms between 1 and 15, more preferably between 2 and 10, most preferably between 2 and 6. Good results were obtained when the branches were ethyl branches (C=2) or butyl branches (C=4). Preferably, the inventive UHMWPE fibers and in particular those spun from UHMWPEs having ethyl or butyl branches, undergo an elongation during their creep lifetime, under a load of 600 MPa and at a temperature of 70° C., of at most 20%, more preferably of at most 15%, even more preferably of at most 9%, yet even more preferably of at most 7%, yet even more preferably of at most 5%, most preferably of at most 3.7%. Such fibers can be obtained for example by using a method such as the one described in application PCT/EP2012/056079 included herein in its entirety by reference. PCT/EP2012/056079 also includes the measuring methods for the amount of olefinic branches, elongational stress, creep lifetime, IV and elongation under creep.

It was observed that the advantages of the invention were more prominent when the offshore vessel of the invention is permanently moored at a location; by permanent mooring being herein understood that said vessel is kept at said location for at least 15 years, more preferably at least 25 years. For such permanently moored vessel it was observed that less maintenance is necessary and the fulfillment of the mooring requirements are satisfied.

The invention relates also to a single length mooring line 20 comprising high strength polyolefin fibers; the single length mooring line 20 having a first portion 20*a* and a second portion 20*b*; wherein the first portion 20*a* 20 of the mooring line has a first mass (M1) of polyolefin fibers per unit length and the second portion 20*b* of the mooring line 20 has a second mass (M2) of polyolefin fibers per unit length; wherein the ratio M1/M2 is greater than 1 and wherein the first portion 20*a* extends continuously into the second portion 20*b* through a tapered portion 20*c* of the mooring line 20. Preferred embodiments of the mooring line 20 of the invention are described hereinabove. Preferably the mooring line 20 of the invention has a length of at least 500 meters, more preferably at least 800 meters, most preferably at least 1100 meters. The mooring line 20 of the invention when used in deep-sea mooring applications, preferably has a portion that resides above the waterline WL and a portion that resides below the waterline WL, with preferred embodiments as described hereinabove. Preferably the portion that resides below the waterline WL is anchored to the ocean floor OF and the portion that resides above the waterline is connected to a winch-drum 10. It was observed that the mooring line 20 of the invention can easily be manufactured to provide the same safety requirements for the intended application, or in other words said line has a constant safety factor, even when used in two separate environments, e.g. outside and inside the water, at the same time.

Figure 3:
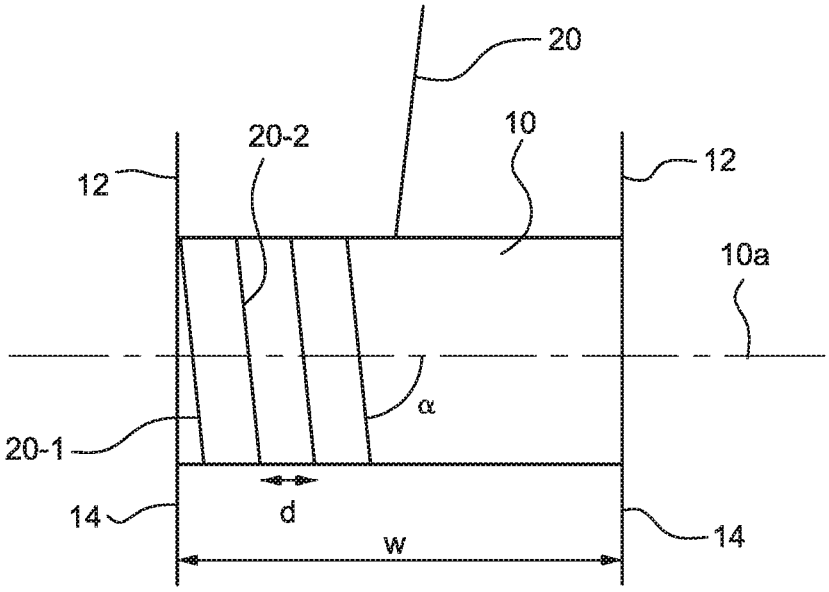
FIG. 3 is a schematic view of a winch-drum assembly that may be employed in the mooring system of the vessel depicted in FIG. 1.

The invention relates also to a mooring system 20, in particular for deep sea applications, comprising a winch drum 10 and an anchoring site and a mooring line 20 extending from the winch drum 10 to the anchoring site, wherein the mooring line 20 is the mooring line of the invention. Preferably, the mooring system MS of the invention comprises the winch assembly 10 as shown in FIG. 3. Specifically, the winch-drum assembly 10 that may be employed in hauling on and paying off the mooring line 20 may include collar parts 12, 14 provided at both ends thereof. A motor (not shown) may be provided for driving the winch drum 10.

The mooring line 20 is shown in FIG. 3 as being wound on the winch drum 10, wherein the mooring line 20 is helically wound with a helical angle (a) in relation to the axis 10*a* of the drum 10 across the width (w) of the drum 10 back and forth such that in a coiled state of the winch (not shown) the drum 10 comprises several layers of rope 20. The spacing (d) between the windings such as a first winding 20-1 and a second winding 20-2 is preferably equal to or larger than the 0.5 diameter of the first portion of the mooring line 20. In the example shown in FIG. 3, the spacing between windings is maximally seven times the diameter of the first portion of the mooring line 20. The winch assembly 10 as shown in FIG. 1 is more specifically described in WO 2011/104310, included herein in its entirety by reference.

Preferably the mooring line 20 of the invention is wound onto a winch-drum 10 having a width (w) to create helical windings, such that in a coiled state the winch-drum 10 comprises several layers of the first portion 20*a* of the mooring line 20, wherein the spacing (d) between the windings of the mooring line 20 is at least 0.5 times the diameter of the first portion 20*a* of the mooring line 20. Preferably, the mooring line 20 is wound with a substantially constant speed across the width (w) of the winch-drum 10. Preferably said spacing is maximally 7 times the diameter.

The invention also relates to the use of a tapered mooring line 20, preferably according to the one used in the present invention, for mooring an offshore drilling or production vessel PV as schematically depicted in FIG. 1.

Measuring Methods

Tensile properties, i.e. strength and modulus, of polyolefin fibers were determined on multifilament yarns as specified in ASTM D885M, using a nominal gauge length of the fibre of 500 mm, a crosshead speed of 50%/min and Instron 2714 clamps, of type Fibre Grip D5618C. For calculation of the strength, the tensile forces measured are divided by the titre, as determined by weighing 10 meters of fibre; values in GPa for are calculated assuming the natural density of the polymer, e.g. for UHMWPE is 0.97 g/cm$^3$.

The tensile properties of polyolefin tapes: tensile strength and tensile modulus are defined and determined at 25° C. on tapes of a width of 2 mm as specified in ASTM D882, using a nominal gauge length of the tape of 440 mm, a crosshead speed of 50 mm/min.

The invention claimed is:

1. An offshore drilling or production vessel comprising:

a platform; and a mooring system attached to the platform, wherein the mooring system comprises:

(i) a support frame with a winch-drum mounted thereon;

(ii) a single length mooring line comprising high strength polyolefin fibers for mooring the platform to the ocean floor, the mooring line comprising a first portion which is hauled on and paid off by the winch-drum and a second portion which is anchored to the ocean floor, wherein the first portion extends continuously into the second portion through a tapered portion of the mooring line; and wherein the first portion of the mooring line has a first mass (M1) of polyolefin fibers per unit length and a specific strength (S1) and the second portion of the mooring line has a second mass (M2) of polyolefin fibers per unit length and a specific strength (S2), wherein the ratio M1/M2 is greater than 1 and the ratio S1/S2 is between 0.50 and 0.98.

2. The vessel of claim 1, wherein, said first portion substantially extends at most 1 meter from the winch-drum.

3. The vessel of claim 1, wherein said second portion substantially extends from at least 100 meters below the waterline.

4. The vessel of claim 1, wherein the ratio M1/M2 is between 1.3 and 3.0.

5. The vessel of claim 1, wherein the first portion of the mooring line has a specific strength of at least 1.3 kN/(g/m).

6. The vessel of claim 1, wherein the second portion of the mooring line has a specific strength of at least 1.5 kN/(g/m).

7. The vessel of claim 1, wherein the polyolefin fibers are fibers manufactured from homopolymers or copolymers of polypropylene or polyethylene.

8. The vessel of claim 1, wherein the polyolefin fibers are ultrahigh molecular weight polyethylene (UHMWPE) fibers.

9. The vessel of claim 1, wherein the polyolefin fibers have a tensile strength of at least 0.5 GPa.

10. The vessel of claim 1 wherein the polyolefin fibers have deniers in the range of from 0.5 to 20.

11. The vessel of claim 1, wherein the polyolefin fibers are creep-optimized UHMWPE fibers obtained by spinning an UHMWPE comprising olefinic branches (OB) and having an elongational stress (ES), and a ratio $$\left(\frac{OB/1000\ C}{ES}\right)$$

between the number of olefinic branches per thousand carbon atoms (OB/1000C) and the elongational stress (ES) of at least 0.2, wherein said UHMWPE fibers when subjected to a load of 600 MPa at a temperature of 70° C., have a creep lifetime of at least 90 hours, preferably of at least 100 hours.

12. The vessel of claim 1, wherein the winch-drum has a width to create helical windings, such that in a coiled state the winch-drum comprises several layers of the first portion of the mooring line, wherein the spacing between the windings of the rope is at least 0.5 times a diameter of the first portion of the mooring line.

13. A single length mooring line comprising high strength polyolefin fibers, wherein the said single length mooring line includes a first portion and a second portion, the first portion extending continuously into the second portion through a tapered portion of the mooring line; and wherein the first portion of the mooring line has a first mass (M1) of polyolefin fibers per unit length and a specific strength (S1) and the second portion of the mooring line has a second mass (M2) of polyolefin fibers per unit length and a specific strength (S2), wherein the ratio M1/M2 is greater than 1 and the ratio S1/S2 is between 0.5 and 0.98.

* * * * *